United States Patent [19]

Young

[11] Patent Number: 4,540,034

[45] Date of Patent: Sep. 10, 1985

[54] MONEY CLIP AND WALLET

[75] Inventor: Raymond W. Young, West Bend, Wis.

[73] Assignee: Amity Leather Products Co., West Bend, Wis.

[21] Appl. No.: 608,373

[22] Filed: May 9, 1984

[51] Int. Cl.[3] ..... A45C 1/06; B42F 1/06

[52] U.S. Cl. ..... 150/137; 150/132; 24/3 R; 24/67 R; 24/67.9; 24/563

[58] Field of Search ..... 150/137, 131, 132, 134; 24/3 F, 3 H, 3 J, 3 L, 67.9, 563, DIG. 9, 3 R, 67 R, 67.3, 67.11

[56] References Cited

U.S. PATENT DOCUMENTS

| | | | |
|---|---|---|---|
| D. 178,869 | 10/1956 | Cousins . | |
| 1,340,180 | 5/1920 | O'Brien . | |
| 1,530,811 | 3/1925 | Brown | 150/137 X |
| 1,599,202 | 9/1928 | Seavey . | |
| 1,793,520 | 2/1931 | Siptrott . | |
| 2,221,648 | 11/1940 | Moore . | |
| 2,335,903 | 12/1943 | Beckett . | |
| 2,419,092 | 4/1947 | Schupbach et al. | 150/137 X |
| 2,455,515 | 12/1948 | Miller . | |
| 2,575,030 | 11/1951 | Smallman . | |
| 2,595,003 | 4/1952 | Seamon . | |
| 2,595,843 | 5/1952 | Grabhorn | 150/137 |
| 2,629,153 | 2/1953 | Ratti . | |
| 2,655,705 | 10/1953 | Hatfield | 150/137 X |
| 2,658,545 | 11/1953 | Weydener et al. | 150/137 |
| 2,719,557 | 10/1955 | Bell | 150/137 |
| 2,737,220 | 3/1956 | Hoff . | |
| 2,746,503 | 5/1956 | Knee | 150/137 X |
| 2,785,722 | 3/1957 | Anderson . | |
| 2,816,590 | 12/1957 | Boots . | |
| 3,131,445 | 5/1964 | Lorber | 24/67.9 |
| 3,220,452 | 7/1965 | Mintzes et al. | 150/137 X |
| 3,261,065 | 7/1966 | Romano . | |
| 3,454,069 | 7/1969 | Machler | 150/137 |
| 3,633,253 | 1/1972 | Ellis | 24/67.9 X |
| 3,962,758 | 6/1976 | Knappe et al. . | |

*Primary Examiner*—William Price
*Assistant Examiner*—Sue A. Weaver
*Attorney, Agent, or Firm*—Fitch, Even, Tabin & Flannery

[57] ABSTRACT

A money clip is provided for holding currency in a wallet wherein the clip is formed from a resilient material, the clip comprising two arms connected with a flexure section, the arms holding the currency by virtue of a flexural torquing deformation around an axis through the flexure section.

4 Claims, 4 Drawing Figures

Fig. 1.
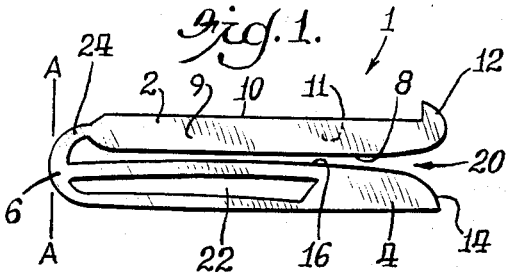
Fig. 2.
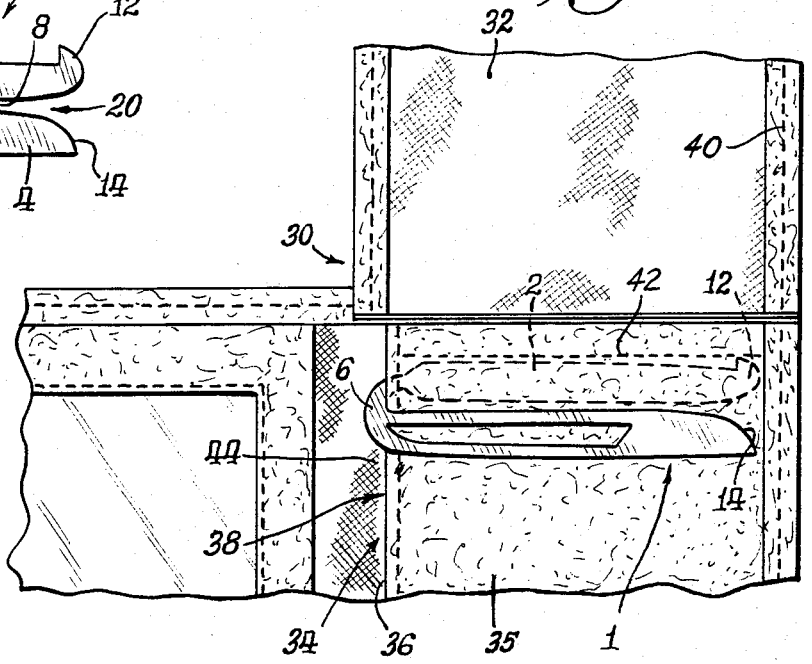
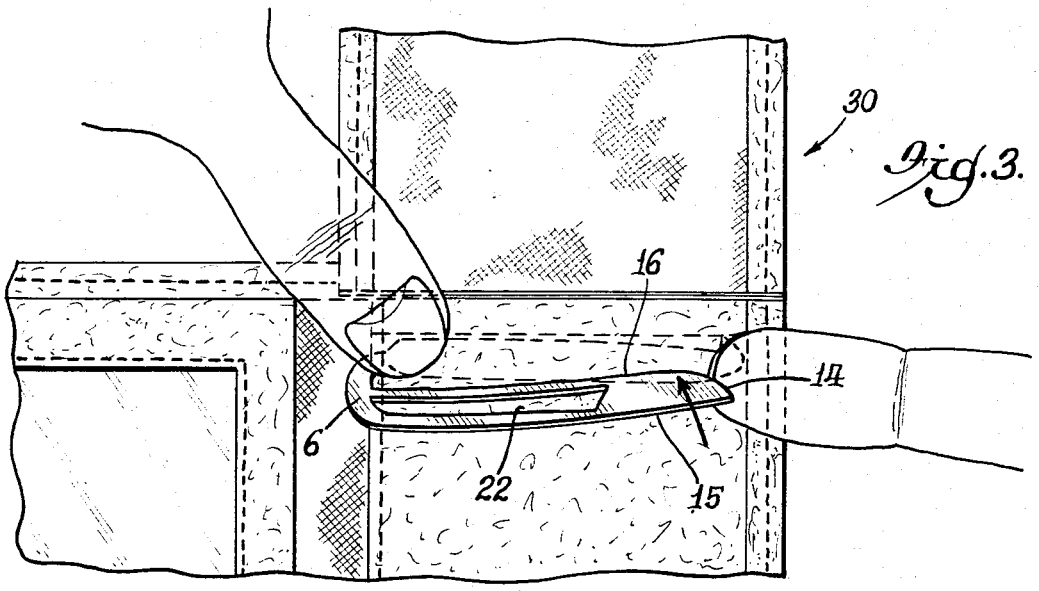
Fig. 3.
Fig. 4.
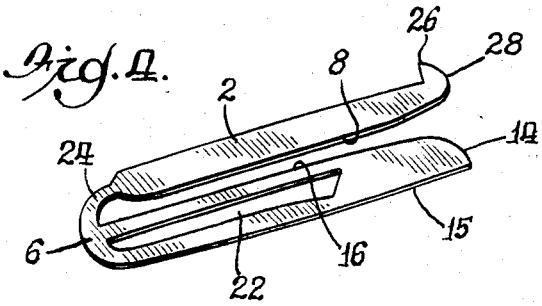

MONEY CLIP AND WALLET

This invention relates to a currency or money clip structure. More particularly, this invention relates to an improved form of money clip for use in conjunction with a wallet.

The use of money clips in connection with holding paper currency has long been known and has been popular. Money clips can be used alone or in conjunction with wallets, the latter use often being preferred such that the user cannot only hold the currency but also credit cards, licenses and other paraphernalia frequently carried in a wallet with paper currency.

Money clips used in conjunction with wallets should be strong and durable, but must not impose excess weight or size requirements on the wallet. Heretofore in order to not impose excess weight requirements on the wallet, money clips often have been insubstantial, frequently subject to fatigue and wear, and often do not provide a completely satisfactory gripping surface to securely hold the clip in the wallet or hold paper currency within the clip and wallet.

U.S. Pat. No. 2,719,557 to Bell describes a currency clip having a shank portion for insertion into a wallet and a curved clip end portion to resiliently hold paper currency within the wallet by mutual interengagement of a curved portion with the shank 30, a wallet portion therebetween. The money clip described in Bell is essentially a wire resiliently formed to hold paper currency against a wallet with the shank portion residing thereunder. Its appearance is insubstantial, it is subject to fatigue and does not provide a particularly satisfactory gripping surface over a large portion of currency and wallet surface thereunder such that the clip is securely held in the wallet or such that the currency is tightly retained within the clip and wallet. U.S. Pat. No. 2,658,545 to Weydener et al. describes a U-shaped spring clip similar to the one described in Bell, except that its rear leg or shank is telescopically and frictionally mounted within the base of a tubular holder which is inserted into a pocket section of a wallet or pocket case. Again, however, the rounded tubular holder as well as the resiliency of the clip portion which engages the paper currency is subject to fatigue and wear. The gripping surface of the clip engages currency only at irregular intervals. Moreover, the frictional engagement of the clip with the wallet and currency is not completely satisfactory. The rounded tubular shank of the clip can be readily slidably withdrawn from the wallet even though the frictional engagement of the clip may be increased by virtue of the thickness of the currency inserted therein.

U.S. Pat. No. 2,785,722 to Anderson and U.S. Pat. No. 2,816,590 to Boots describe clips which have a more substantial appearance. Such clips, however, have the inherent disadvantage of more weight and bulk. Moreover they do not provide any substantial improvement as to being less prone to fatigue. Nor do they provide a substantial gripping action to retain the clip in the wallet or paper currency therein. There is a curved gripping surface for the currency which only grips the currency in small areas thereby not providing a completely satisfactory surface. Further in each of the latter patents there is a mechanical assemblage which has a proclivity to wear.

It is an object of this invention to provide a lightweight money clip without bulk for use in conjunction with a wallet.

It is also an object of this invention to provide a money clip with an improved gripping action to secure the clip within a wallet.

It is a further object of this invention to provide a money clip with an improved gripping surface area to maintain currency within the clip and a wallet.

It is another object of this invention to provide a money clip which not only has a substantial appearance, but is a clip which actually has strength, durability and is not subject to excessive fatigue.

It is still another object of this invention to provide a money clip which is securely held to a wallet and readily and easily provides access to paper currency within the gripping areas of the clip.

Other objects and advantages of the invention will become apparent from the following detailed description taken in connection with the accompanying drawings, in which:

FIG. 1 is a plan view of the currency clip;

FIG. 2 is the currency clip inserted into a wallet;

FIG. 3 is a diametric view of the currency clip in a wallet with the gripping arm of the clip being resiliently held in an open position for the insertion of currency; and FIG. 4 is a perspective view of the currency clip.

In accordance with the present invention a thin substantially planar currency clip is provided for use in connection with holding paper currency in a wallet having a pocket. The currency clip is formed from a resilient material, the clip comprising an anchor arm and a juxtaposed gripping arm, such arms being connected with a U-shaped flexure section. The anchoring arm includes an anchoring toe and anchoring surface which includes anchoring edges and anchoring area to retain the clip in the wallet. The gripping arm includes a jaw and gripping surface which includes a gripping edge and a gripping area, the jaw facilitating insertion of paper currency between the pocket in the wallet and the gripping edge. The gripping surface of the gripping arm holds paper currency by resilient torquing action which exerts a flexural force generally perpendicular to the plane of clip with the gripping area and edge generally pressing the currency onto the wallet surface to securely hold the currency to such wallet surface. The anchoring toe and anchoring edges frictionally engage the interior surfaces of the wallet pocket to hold the clip therein.

Referring now to FIG. 1 of the drawings, a flat planar currency clip 1, made of spring steel or other like resilient material, is comprised of a planar anchor arm 2, a planar gripping arm 4 which is in the plane formed by the anchor arm and is juxtaposed thereto, the anchor arm and gripping arm arcuately connected by flexure section 6. The anchor arm is for insertion into a wallet pocket. The anchor arm includes an anchor surface which comprises inside anchor edge 8, outside anchor edge 10, anchor areas 9 and 11 therebetween and anchor toe 12.

The flat planar gripping arm includes a jaw 14 and a gripping surface which includes a gripping edge 16 and gripping area 15. (FIG. 4) The jaw is curvingly connected with the gripping surface and facilitates slidable access of paper currency to the interior area 20 of the clip. The gripping surface including the gripping area and gripping edge of the clip securely holds currency to a wallet surface upon flexural torquing deformation of the gripping arm around the axis A—A of the pivot section such that the gripping arm lies slightly outside the plane of the clip thereby resiliently securing the clip to the wallet and currency to said wallet pocket surface as will hereinafter be described in more detail.

A hollow or open section 22 is interior to the gripping arm to reduce the weight and bulk of the clip. The interior area 20 terminates in a notch 24, the notch providing an area to accommodate stitching and sewn areas in the wallet when the clip is inserted into the wallet pocket. The anchor arm 2 terminates in the anchor toe 12 which has a head section 26 and a heel section 28. The head section 26 includes a lip which is perpendicular from the outer anchor edge 10, the toe curvingly terminating in the heel section 28. (See FIG. 4)

FIG. 2 shows the currency clip in a wallet 30. The wallet 30 includes a flap 32, an outer wall 34, and an inner wall 36 having an exterior surface 35 and an interior surface. The inner wall 36 is sewn as at 42 and 40 onto the interior surface 44 of the outer wall 34 forming a pocket 38. Reinforcement backing material is sewn on the interior surfaces of the wallet which is made of leather or other like material to provide additional strength and durability to the wallet.

As illustrated in FIG. 2, anchor arm 2 of clip 1 is inserted into the pocket 38 of the wallet the anchor arm 2 extending interior to said pocket, the gripping arm 4 extending topically over the exterior surface 35 of the pocket. The thickness of the inner wall 36 causes a resilient flexural torquing deformation, as generally shown in FIG. 3, on the clip resulting in the arms of the clip pivoting around axis A—A through flexure section 6, such axis generally perpendicular to and in the plane of the arms. When the anchor arm is in inserted into pocket 38, the thickness of the material from which the wallet and pocket are made resiliently deforms the clip such that the anchor arm is rotated below the plane of the clip and the gripping arm is rotated above the plane of the clip. This creates a resilient gripping action through the coaction of the gripping surface of the gripping arm and the anchoring surface of the anchoring arm. The gripping surface frictionally engages the exterior surface 35 of the pocket, and the anchoring surface frictionally engages the interior surfaces of pocket 38. More particularly the anchoring edge 8 and anchoring area 9 of the anchoring arm frictionally engage the interior surface of the inner wall 36 which forms the pocket. The anchor toe generally frictionally engages the interior of surfaces of the pocket. All of the latter coacting to secure said clip to said pocket and wallet.

When currency is inserted between the exterior surface 35 of the pocket and the gripping edge 16 and area 15 of the gripping arm 4 of the clip, the jaw 14 of the clip is raised up and away from the exterior surface of the pocket to readily permit slidable insertion of the paper currency into the interior area 20 of the clip. This not only facilitates insertion of currency into the interior area of the clip, but creates a flexural torquing action between the anchor arm and the gripping arm such that the outer anchoring edge 10, the anchor toe 12 and outer surface 9 of the anchoring arm are driven into and frictionally engage the interior surface of the pocket to prevent the clip from sliding from the pocket during the stress of the slidable insertion of currency into or out of the exterior area of the clip. With the insertion of currency the currency lies between the gripping edge and gripping area of the clip and the exterior surface 35 of the pocket. More particularly, when the jaw of the clip is raised, anchoring edge 10 is driven into the interior surface 44 of outer wall 34 of the pocket 38 for frictional engagement therewith, the anchoring edge 8 frictionally engages the interior surface of the inner wall 36 and gripping edge 16 grips the outer surface of the pocket and or currency therebetween. Moreover as more currency is inserted into the clip, more flexural torque deformation is generated for a tighter gripping action of the clip to the currency and wallet.

As shown in FIG. 3, which is a diagrammatic view of the clip 1 in wallet 30, the clip provides improved coaction between the anchor arm with its anchoring surface and the gripping arm with its gripping surface to provide an improved and more secure grip between the clip and the wallet. Moreover, the clip provides an exceptional gripping action to secure the paper currency to the exterior surface of the pocket 38 of the wallet. After the paper currency is inserted between the gripping surface of the clip and the exterior surface of the wallet, the gripping edge and the gripping area of the gripping arm axially pivot around flexure section 6 and provide a resilient flexural torquing action against the exterior surface of said pocket and said paper currency. This action holds the paper currency between the gripping edge and gripping area and the exterior surface of the pocket. As more currency is inserted, more flexural torque deformation is generated to lift the gripping surface off the surface of the currency, but to more tightly bond the gripping edge onto the currency to secure it within the clip and wallet.

While a preferred embodiment of the invention has been shown and described in conjunction with a wallet with a pocket, the wallet being constructed of leather or the like, the currency clip which is shown and described may be used in conjunction with any appropriate wallet permitting the resilient rotational deformation of the clip to resiliently hold the paper currency on a substantial planar surface of the wallet. The preferred embodiments as shown and described, therefore, are intended to cover all modifications and constructions falling within the spirit and scope of the invention as defined in the appended claims.

What is claimed is:

1. In a wallet having a pocket formed from an inner wall with an interior and exterior surface and outer wall, a currency clip comprising:

a planar anchor arm for insertion into said pocket;

a planar gripping arm juxtaposed to and in the plane of said anchor arm and spaced therefrom throughout its length;

a flexure section at one end of said anchor arm and gripping arm arcuately connecting said anchor arm and said gripping arm defining an interior area between said arms permitting slidable insertion of said anchor arm into said pocket;

said anchor arm having an anchor surface, said gripping arm having a gripping surface;

said anchor surface comprising an inside anchoring edge, an outside anchoring edge and an anchoring area therebetween;

said gripping surface comprising a gripping edge and a gripping area, said anchoring arm and gripping arm resiliently moving from their coplanar position flexing around said flexure section upon insertion into said pocket to provide a resilient gripping deformation torque around an axis which is through said flexure section and which is perpendicular to said gripping and anchor arms and in a plane formed by the gripping and anchor arms, said inside anchoring edge frictionally engaging the interior surface of the inner wall, said gripping edge frictionally engaging the exterior surface of the inner wall and surface of the currency therebetween when inserted therein, said frictional engagement of the gripping edge and said anchoring edge increasing with increased flexural deformation torque created by the insertion of paper currency between said gripping surface and the exterior surface of the inner wall, thereby securing said clip to said wallet and currency inserted between said exterior surface and said gripping surface.

2. In a wallet, a currency clip as recited in claim 1 wherein, said anchor arm includes an anchor toe which frictionally engages an interior surface of the outer wall of the wallet with the flexural deformation torque created by the insertion of paper currency between said gripping surface of the exterior surface of the inner wall.

3. In a wallet, a currency clip as recited in claim 1 wherein said flexure section is U-shaped.

4. In a wallet, a currency clip as recited in claim 2 wherein said flexure section is U-shaped.

* * * * *